United States Patent [19]

Gonsior

[11] 4,103,784

[45] Aug. 1, 1978

[54] SINGLE LINE, TRACTION DRIVEN RUNNING SKYLINE SYSTEM

[75] Inventor: Michael J. Gonsior, Missoula, Mont.

[73] Assignee: The United States of America as represented by the Secretary of Agriculture, Washington, D.C.

[21] Appl. No.: 792,366

[22] Filed: Apr. 29, 1977

[51] Int. Cl.[2] ..... B66C 21/00

[52] U.S. Cl. ..... 212/94; 212/106; 212/120; 254/172

[58] Field of Search ..... 212/76–123; 254/172

[56] References Cited

U.S. PATENT DOCUMENTS

| | | | |
|---|---|---|---|
| 602,168 | 4/1898 | Palmer | 212/89 |
| 682,666 | 9/1901 | Brown | 212/89 |
| 773,295 | 10/1904 | Miller | 212/90 |
| 2,035,107 | 3/1936 | Voss | 212/89 |
| 2,250,985 | 7/1941 | Benson | 254/172 |
| 3,713,548 | 1/1973 | Hanke | 254/172 |
| 3,874,517 | 4/1975 | Raven et al. | 212/84 |

FOREIGN PATENT DOCUMENTS

| | | | |
|---|---|---|---|
| 602,145 | 9/1934 | Fed. Rep. of Germany | 212/94 |

*Primary Examiner*—Lawrence J. Oresky
*Attorney, Agent, or Firm*—M. Howard Silverstein; David G. McConnell

[57] ABSTRACT

A continuous, single line, traction driven cable transportation system, intended for logging applications but not limited thereto. The system is open, such that line can be added to it at any time, whether during rigging, or during operation. Thus, theoretically, there is no limit to the system's longitudinal or lateral distance capabilities. The carriage maintains a fixed position during lateral yarding phases of operation and the system may be tightened or loosened at will.

Two modifications of the system described above; a noncontinuous, single line, traction driven cable transportation system. The modified systems contain a skidding winch on which only a fixed amount of skidding line is wound, thereby limiting the lateral skidding distance capability of the system.

11 Claims, 11 Drawing Figures

SINGLE LINE, TRACTION DRIVEN RUNNING SKYLINE SYSTEM

BACKGROUND OF THE INVENTION

1.

Field of the Invention

The invention relates to transporting loads over unspecified distances, principally though not exclusively in steep, mountainous terrain. The general, though not exclusive, field of application is logging.

2. Description of the Prior Art

The methods for transporting loads by cable systems are so numerous as to defy any reasonably concise summarization. Examples of applications are elevators, ski lifts, suspension bridges and, of course, log yarding systems. Even if interest is confined to logging applications, one will find an immense variety of methods for arranging cables to accomplish particular tasks.

One of the simplest of existing cable yarding systems is the live or standing skyline without a carriage haulback line (see FIG. 1, note that the yarder tower is not sketched, but is represented by the initial vertical rise of the cables from the storage drums). Such a system relies upon gravity to return the empty carriage to the woods. To enable maintaining the carriage in a fixed position while lateral yarding (movement of logs toward the center of a skyline road) it is necessary in many systems that the carriage be clamped to the skyline. Once clamped to the skyline, the carriage position cannot be adjusted to facilitate lateral yarding. Thus, care in positioning the carriage before clamping is of considerable importance, especially in selective logging situations. Slack in the dropline (line running from the carriage to the logs) is usually pulled manually, and so slope and defection (the vertical distance between the chord (an imaginary straight line between the top of the yarder tower and the tailblock) and the skyline, measured at midspan) must be within certain limits to avoid excessive difficulty. Obviously, such a system is suitable only for uphill yarding, but it may be designed for multispan yarding (i.e., wherein the skyline has one or more intermediate supports).

By incorporating a haulback line, a more versatile system is possible (see FIG. 2). In many cases, it is still necessary to clamp the carriage to the skyline for lateral yarding, primarily to permit slack-pulling. Alternatively, separate machine-driven lines for slack-pulling may be incorporated; or the carriage may carry its own radio-controlled power supply and winch line. Such systems may also be designed for multispan operation.

Thus, it is possible to yard in virtually any situation with a live or standing skyline. Principle difficulties are that: (1) slack-pulling, especially in downhill yarding situations, is either expensive or difficult to accomplish; and (2) passage of the carriage over intermediate supports is difficult in uphill yarding situations.

Perhaps the most versatile of single-span cable yarding systems is the running skyline with mechanical slack-pulling carriage (see FIG. 3). Such a system permits downhill as well as uphill yarding, and enables complete control of the carriage during lateral yarding without requiring clamping devices. Of course, there are limits on the length of span, depending on drum and line sizes; and the lateral yarding distance is limited by the length of dropline. Moreover, such systems entail the operation of drum against drum, thus requiring interlocking drive mechanisms and/or causing appreciable power losses; and there are no known running skyline systems which are designed for multispan operations.

Among the limitations and disadvantages of existing yarding systems are:

(1) Limited span capabilities (owing to the need for power and storage drums to be coincident, and the limits on lengths of lines of particular sizes which can be stored on a drum of given dimensions);

(2) limited lateral yarding capabilities (i.e., limited amount of line which can be fed out of the carriage) due either to reasons in (1) above or due to the limitations on manual slack-pulling at any particular slope and deflection;

(3) the need for relatively large cables under conditions of moderate loads and small deflections; and (4) high fixed costs for systems which are versatile, highly productive and capable of being moved and rigged relatively rapidly; or high operating costs for systems which are less versatile, less productive and more difficult to move and rig.

The proposed system and its modifications purport to overcome, or at least ameliorate, all of the above limitations.

SUMMARY OF THE INVENTION

In general, the basic theory of the original invention is that loads can be suspended from and transported on a single cable which is arranged in a particular fashion. Elevation and transportation are accomplished by cable movement which is effected by a unique arrangement of stationary and moving traction drives.

In the modified versions transportation is also accomplished by a single cable arranged in a particular fashion. However, loads are suspended from a cable which is distinct from that used to accomplish transportation.

The system and its modifications are similar to most existing systems in that they incorporate a yarder and power source, a yarder tower, and a carriage. Likewise similar to existing systems anchorages for the yarder and tailblock are required.

The system and its modifications are believed to be new and unique in that:

(1) they accomplish with a single cable what other systems require three or four cables to accomplish;

(2) the storage drums are separate from the power drives, thereby permitting a wider choice of drum sizes to be used and thus increasing the possible span capabilities of the system (there are limits on the lengths of lines of particular sizes which can be stored on a drum of given dimensions);

(3) the systems are powered by traction drives which are of equal diameters, and which operate at identical speeds, thereby eliminating the need for interlocking drive mechanisms and/or energy-wasting brakes. However, as will be discussed, it may be desirable and is possible, in the modified versions to establish a drive ratio other than unity between the traction drive and the skidding winch such that the load in the skidding line may be significantly greater than that in the segment of the main cable which is operating the traction drive;

(4) for a given configuration of load, span and deflection, the load carrying capabilities are greater than any existing systems with a given line strength or size; hence a smaller diameter cable can be used. For example, at a particular deflection and for a given line diameter, the load-carrying capability of the new system is twice that of a conventional running skyline and four times as great as that of a live or standing skyline with gravity-return carriage. The load capacity of a live or standing skyline system with a haulback line varies from one-fourth to more than one-half that of our system, depending upon deflection. Alternatively, for a given load capacity, the cross-sectional area of the line in the new system need be only half as large as that of the haulback line in a conventional running skyline, and only one-fourth as large as that of the skyline in the live or standing skyline system with gravity-return carriage.

In addition, the carriage of the new systems is designed to pass on intermediate support. Thus, adverse topographic conditions can be overcome with this system in two ways: (1) either by extending the span sufficiently far to gain needed single-span deflection or (2) by placing intermediate supports in suitable locations.

One of the most important characteristics of any cable yarding system is the ease and rapidity with which it can be moved, rigged and unrigged. The new concept, though seemingly more complex than existing systems, nevertheless is readily rigged and unrigged under machine power. As with most cable systems, it is necessary to rig a "strawline" (a light cable used to string heavier lines over a support) as well as make certain anchoring preparations at both ends of the corridor. Once the strawline has been rigged and all other necessary preparations made, the process of rigging becomes one of relative ease and speed, with the yarder supplying all necessary power. There are several methods for rigging, all of which are comparable in time and difficulty with the methods used in rigging conventional running skyline systems. These are, of course, somewhat more difficult and time-consuming than for live or standing skyline systems on relatively short, steep uphill yarding corridors. The new concept incorporates multispan capabilities and, as with any systems having such capabilities, the time and difficulty involved in rigging intermediate supports is appreciably greater than for single-span applications. Although still in the conceptual stages, the intermediate support for the new system is likely to be quite heavy. However, the envisoned rigging procedure involves transport of the intermediate support on the cable system itself, thus requiring less effort by the workmen than would be required for any existing system, no matter how lightweight the manually transported intermediate support devices might be.

In summary, the chief mechanical differences between the new concept and other existing systems is that line diameter is significantly reduced for a given payload, although total weight of line required is essentially unchanged. Because the line is of smaller diameter and greater length, it is expected that costs associated with operation of the cable will be less than in other systems. Among the reasons for this expectation are:

(1) smaller permissible sheave diameters for given levels of fatigue life, and (2) greater ease in handling and splicing.

DESCRIPTION OF THE PREFERRED EMBODIMENT

Figure 4:
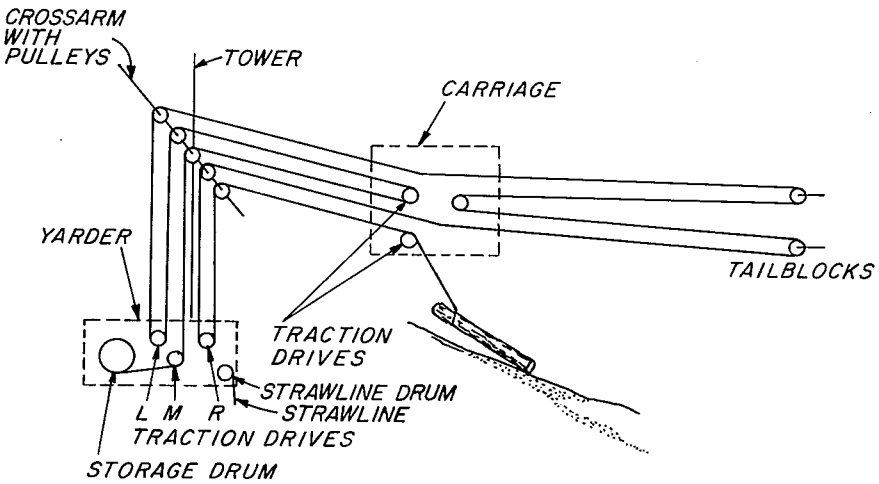
FIG. 4 is a pictoral view of the preferred embodiment of the original system showing the arrangement of cable, traction drives, storage drum, carriage, and tailblocks. The storage drum and three traction drives are located on the yarder. The carriage contains two traction drives. Again the yarder tower is not sketched, but is represented by the initial vertical rise of the cable from the traction drives on the yarder.

Referring to FIG. 4, each of the three traction drives in the yarder (labeled L (left), M (middle), and R (right), respectively) may be driven either clockwise or counterclockwise, or may be prevented from rotation by brakes.

A slight clockwise rotational force (or moment) is maintained on the storage drum at all times such that, when the system calls for cable, this force or moment can be readily overcome and line can be withdrawn from the storage drum; but when cable is being released from the system, the storage drum readily accepts it.

If the amount of cable on the storage drum is inadequate for a particular circumstance, cable can continue to be fed into the system by attaching more to the end of the cable on the drum.

There are four basic operating modes for the system illustrated in FIG. 4: carriage outhaul, carriage inhaul, lateral outhaul, and lateral inhaul.

Figure 2:
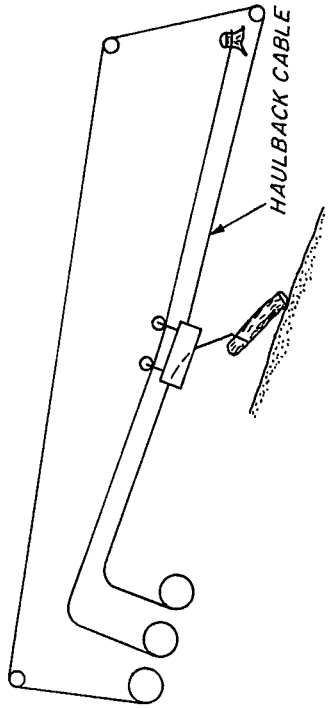
FIG. 2 Prior Art
FIG. 2 is a pictorial view of an existing yarding system: the live or standing skyline with haulback cable.
Figure 1:
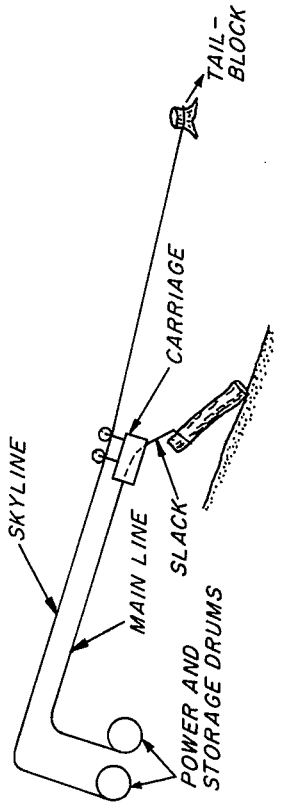
FIG. 1 Prior Art
FIG. 1 is a pictorial view of a simple existing yarding system: the live or standing skyline without a carriage haulback line. The yarder tower is not sketched, but is represented by the initial vertical rise of the cables from the power and storage drums.
Figure 3:
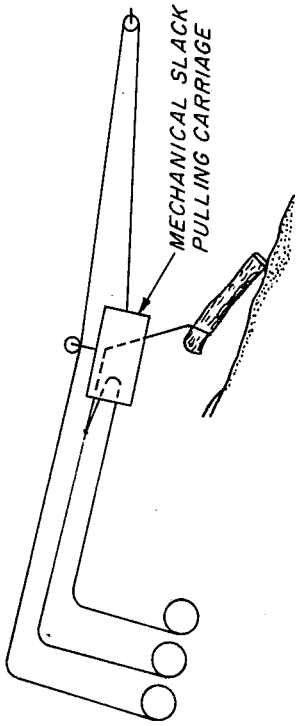
FIG. 3 Prior Art
FIG. 3 is a pictorial view of an existing single-span cable yarding system: the running skyline with mechanical slack-pulling carriage.
Figure 5:
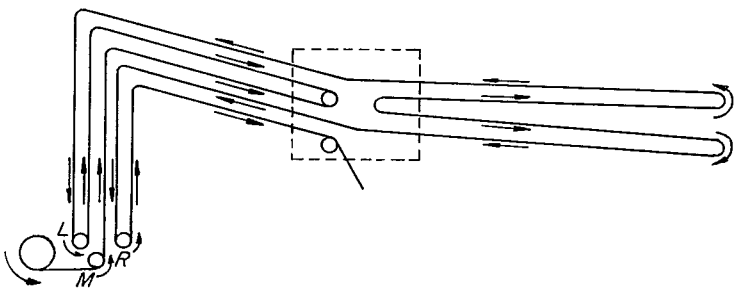
FIG. 5 is a schematic drawing of the system illustrated in FIG. 4 when operated in the carriage outhaul mode of operation.

Referring to the carriage outhaul mode of operation, illustrated in FIG. 5, of the system shown in FIG. 4, all three traction drives in the yarder are rotated in a counterclockwise direction. This withdraws cable from the storage drum and causes the carriage to move away from the yarder.

The carriage inhaul mode of operation is merely the reverse of the carriage outhaul mode. All three traction drives in the yarder are rotated in a clockwise direction, cable is accepted by the storage drum and the carriage moves towards the yarder. This mode of operation may be envisioned by reversing the direction of all arrows in FIG. 5.

Figure 6:
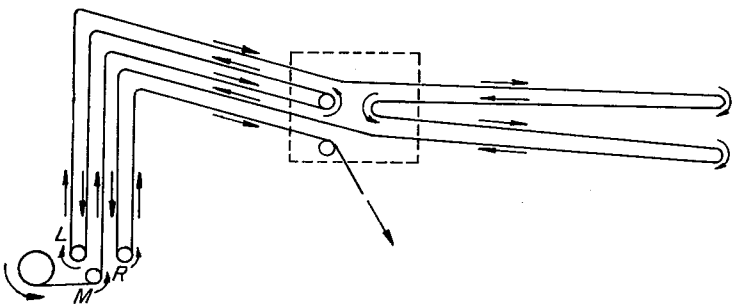
FIG. 6 is a schematic drawing of the system illustrated in FIG. 4 when operated in the lateral outhaul mode of operation.

Referring to the lateral outhaul mode of operation, illustrated in FIG. 6, of the system shown in FIG. 4, traction drive L is rotated clockwise while traction drives M and R are rotated counterclockwise at the same speed. This causes the upper traction drive in the carriage to rotate in a counterclockwise direction which imparts a clockwise rotation to the lower traction drive in the carriage which, in turn, pulls the cable from traction drive R and feeds it out of the carriage. The carriage remains in a stationary position during this mode of operation.

The lateral inhaul mode of operation is merely the opposite of the lateral outhaul mode of operation. Traction drive L is rotated counterclockwise, while traction drives M and R are rotated clockwise at the same speed. The carriage remains stationary while the dropline is pulled toward the carriage. The storage drum must accept line due to the slight clockwise rotational force maintained on it. This mode of operation may be envisioned simply be reversing the direction of all arrows of FIG. 6.

In addition to the four basic operating modes previously described, it is possible to loosen the entire system if the carriage is designed to enable disengaging the upper and lower traction drives. This is accomplished through a mechanism which permits the lower traction drive to recede from the upper traction drive whenever there is a load on the dropline or whenever an enlargement on the end of the dropline is pulled tight against the bottom of the carriage.

Figure 7:
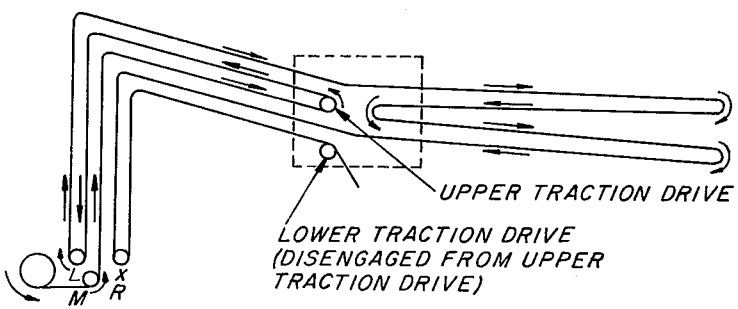
FIG. 7 is a schematic drawing of the system illustrated in FIG. 4 when operated in the loosening or slackening mode of operation.

Referring to FIG. 7, to loosen the system and enable the carriage to drop in elevation over a relatively fixed location, the lower traction drive must first be disengaged from the upper traction drive in the carriage. This is accomplished, as mentioned above, by either loading the dropline or inhauling the unloaded dropline until an enlargement at its end is tight against the bottom of the carriage. The right traction drive R is then placed in a neutral, braked condition (represented in FIG. 7 by a small $x$) while traction drives L and M are rotated at the same speed in clockwise and counterclockwise directions, respectively.

Tightening the system and enabling the carriage to rise in elevation over a relatively fixed location is simply the reverse of loosening the system. Tightening can best be envisioned by reversing the direction of all arrows in FIG. 7. Again, the traction drives in the carriage must be disengaged, the traction drive R in the yarder left in the neutral, braked position.

Figure 8:
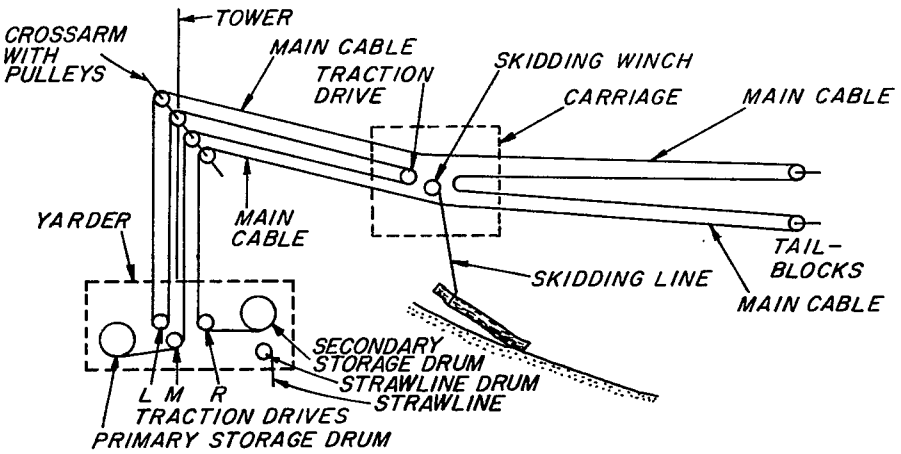
FIG. 8 is a pictorial view of the preferred embodiment of the first modified version of the system illustrated in FIG. 4. Note that the cable is wound on a second storage drum located on the yarder after passing through traction drive R, rather than proceeding to the carriage as in the original version. Note also that the lower traction drive in the carriage of the original version has been replaced by a winch upon which is wound a finite quantity of skidding line.

Referring to FIG. 8, the principal distinguishing feature of the first modified system is that the cable is wound on a second storage drum located on the yarder after passing through traction drive R, rather than proceeding to the carriage as in the original version. Another difference is that the lower traction drive in the carriage of the original version has been replaced by a winch or drum upon which is wound a finite quantity of skidding line. This winch or drum can be engaged with or disengaged from the upper traction drive by means similar to the provision for engagement or disengagement between the lower and upper traction drives in the original version. However, when the skidding winch is disengaged from the traction drive, it is simultaneously braked and prevented from unwinding, thereby being capable of suspending a load without dropping same.

Figure 9:
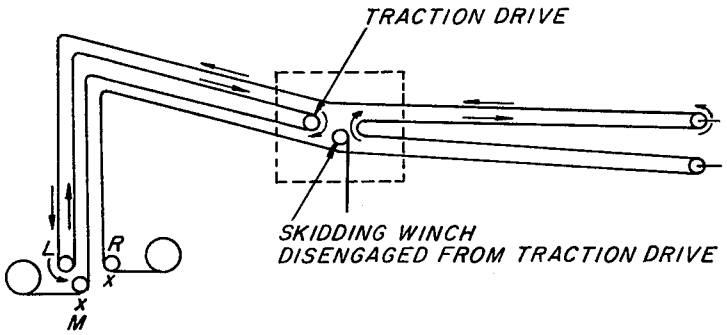
FIG. 9 is a schematic drawing of the system illustrated in FIG. 8 when operated in the carriage outhaul mode of operation.

Referring to the carriage outhaul mode, illustrated in FIG. 9 of the modified system shown in FIG. 8, note that only the left traction drive (L) needs to be operated in this mode, while traction drives M and R and the two storage drums on the yarder remain stationary (represented in FIG. 9 by a small $x$ under both traction drives M and R). Note also that this mode results in a rotation of the traction drive in the carriage. As it is usually desired that the skidding winch in the carriage not rotate, it is essential that the skidding winch be disengaged from the traction drive in the carriage while operating in this mode.

The carriage inhaul mode of operation for the first modified system is simply the reverse of the carriage outhaul mode and may be envisioned by reversing the process described in conjunction with FIG. 9.

In the original version of the system, all principle modes of operation entail rotation of the primary storage drum. In situations wherein only a minor portion of the available cable is necessary (i.e., where distances between the yarder and tailblocks are short in relation to the amount of cable on the storage drum) the storage drum is not unlike a large flywheel in that it possesses considerable inertia, thereby requiring appreciable power consumption in accelerating from standstill to the desired carriage speed. The first modified version eliminates storage drum rotation during the carriage inhaul and outhaul modes of operation thereby eliminating the need for the appreciable power consumed in acceleration of the storage drum.

Figure 10:
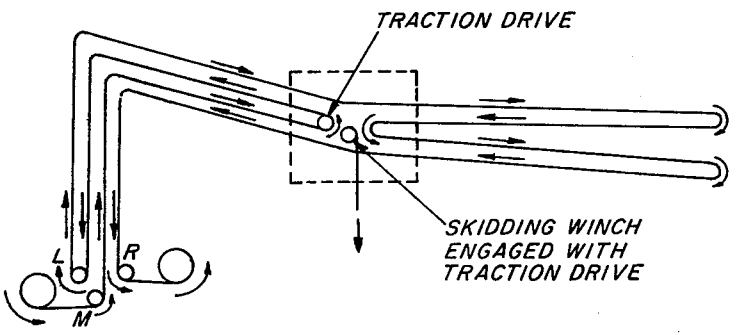
FIG. 10 is a schematic drawing of the system illustrated in FIG. 8 when operated in the lateral outhaul mode of operation.

Referring to the lateral outhaul mode of operation for the first modified system, illustrated in FIG. 10, note that the carriage remains stationary while line is unwound from the skidding winch. The directions and speeds of rotation of the traction drives and primary storage drum are exactly the same as in the original version (i.e., traction drive L is rotated clockwise while traction drives M and R are rotated counterclockwise at the same speed). The main cable, however, is being wound onto the secondary storage drum at the yarder, rather than being fed out of the carriage as in the original version. The skidding winch is engaged with the traction drive in the carriage, and is caused to unwind, thereby releasing skidding line toward the ground.

The lower traction drive in the carriage of the original version requires a relatively large number of revolutions or "wraps" of the cable in order to prevent slippage during the lateral outhaul mode. Consequently, when loaded, the sizes of shafts and bearings required are conceivably of a size and quality as to necessitate undesirable weight and complexity in the carriage. This requirement is alleviated in the first modified version by using a skidding winch to replace the lower traction drive in the carriage.

The above requirement can also be alleviated by a second modification of the system. The line configuration and operating modes of the second modification are virtually identical to the first modification. The difference is that the last segment of line is caused to be wrapped onto a drum in the carriage after passing around traction drive R in the yarder during the lateral outhaul phase, rather than to be wrapped onto a drum in the yarder. As in the first modification, the drive ratio between the traction drive in the carriage and skidding winch need not be unity; however, the storage drum in the carriage and the traction drive in the carriage must be matched to provide that the rate at which line is wrapped onto the storage drum in the carriage (or withdrawn therefrom during the lateral inhaul mode) is equal to the rate at which line passes around the traction drive in the carriage.

In the first modification, power for operating the skidding winch is derived from the traction drive in the carriage. In contrast, in the second modification, power only for unwinding the skidding winch needs to be derived from that traction drive, whereas for winding (elevating the load to the carriage) the power may be derived from the tension in the final segment of the continuous line via engagement of the storage drum in the carriage and skidding winch.

In the second modification, the storage drum in the carriage and skidding winch are always engaged with each other in whatever the desired gear ratio (unity or otherwise). The traction drive in the carriage is disengaged from the storage drum in the carriage and skidding winch whenever the skidding line is loaded beyond some threshold value and/or whenever an enlargement on the end of the skidding line is brought tight up against the carriage, as in the original and first modified versions.

As in the first modification, the second modification has limited lateral yarding distance capability (defined by the amount of line on the skidding winch). The method of powering the skidding winch in the second modification is probably superior to that in the first modification, in that there can be no slippage between the storage drum in the carriage and skidding winch whereas there is a potential for the line to slip around the traction drive in the carriage in the first modification.

The lateral inhaul mode of operation of the first modification is simply the reverse of the lateral outhaul mode and may be envisioned by reversing the process described in conjunction with FIG. 10. During lateral inhaul, the loaded skidding line is caused to be wound onto the skidding winch due to its engagement with the traction drive in the carriage. As previously mentioned, it may be arranged to establish a drive ratio other than unity between the traction drive and skidding winch such that the load in the skidding line may be significantly greater than that in the segment of the main cable which is operating the traction drive. For example, if it is provided that the length of main cable which passes around the traction drive in the carriage is $n$ times the corresponding amount of skidding line which is wound onto the skidding winch during the same time period, then it can be shown that the load in the skidding line may be $n$ times the resultant load in the main cable. Thus a "leverage" or "block and tackle" effect may be realized in this modified version, at least in regard to retrieval of the loaded skidding line. The basic load carrying capability of the system during carriage inhaul remains virtually unchanged from that in the original version.

Figure 11:
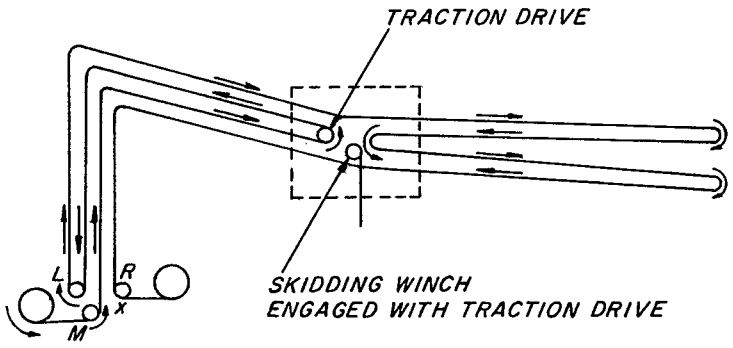
FIG. 11 is a schematic drawing of the system illustrated in FIG. 8 when operated in the loosening mode of operation.

Referring to FIG. 11, to loosen the modified system illustrated in FIG. 8 and enable the carriage to drop in elevation over a relatively fixed location, the skidding winch must first be disengaged from the upper traction drive in the carriage. The right traction drive R is then placed in a neutral, braked condition while traction drives L and M are rotated at the same speed in clockwise and counterclockwise directions respectively.

Tightening the modified system and enabling the carriage to rise in elevation over a relatively fixed location is simply the reverse of loosening the system.

Although not essential to the operation of the original version, it would be extremely desirable to incorporate cable stress monitoring equipment so as to avoid overloading the cable. In the modified versions, it is possible through hydraulic drive mechanisms or even through mechanical brakes to arrange for either or both of the storage drums to slip whenever the load in the cable exceeds a specified level. It can be shown that by enabling the primary and secondary storage drums in the modified systems to slip, the load at any point in the main cable can be reduced, while by enabling the single (primary) storage drum in the original system to slip, only a load on the cable between the storage drum and the left-most traction drive (L) on the yarder can be reduced. Thus, the modified versions enable the use of automatic fail-safe provisions with regard to cable strength in any portion of the main cable, while providing for the same fail-safe provision in the original system would require the use of stress monitoring equipment, at least as regards the portion of the main cable not running between the storage drum and the left-most traction drive (L) in the yarder.

For either the original or modified versions of the system there are a total of 27 combinations of positions for the three traction drives on the yarder, one of which consists of all three being in the neutral, braked condition. Thus, there are 26 operating modes at the yarder. In addition, there are three possible states for the carriage, namely (1) traction drives engaged with dropline extended out of carriage, (2) traction drives disengaged with dropline extended out of carriage and loaded, and (3) traction drives disengaged with dropline pulled tight against the bottom of the carriage. Consequently, a total of at least $3 \times 26 = 78$ modes of operation are possible. Of course, it is unlikely that any but a few of these would ever be necessary for most normal operations.

Having thus disclosed our invention we claim:

1. A traction driven cable transportation system comprising:

(a) a yarder containing:

(1) Three traction drives (a left, a middle, and a right traction drive) each of which may be driven, without regard to the manner in which the others are being driven, either clockwise or counterclockwise, or may be prevented from rotating by brakes; and (2) a storage drum, upon which a slight clockwise rotational force is maintained such that when the system calls for cable this force can be readily overcome enabling line to be withdrawn from the drum, but when cable is being released from the system the storage drum readily accepts it; which is distinct from any power drives enabling great variation in the dimensions of said drum and thus great variation in the amount of line which can be stored on said drum;

(b) a yarder tower;

(c) a carriage which contains an upper traction drive and which is designed to pass an intermediate support;

(d) a source of power;

(e) tailblocks;

(f) a single line which constitutes a support member for said carriage, a hauling cable for said carriage and a haulback line for said carriage; and (g) anchorages for said yarder and said tailblocks; and
(h) a strawline, drum, and tower for rigging purposes.

2. The system of claim 1 wherein:
(a) said carriage also contains a lower traction drive;
(b) said single line:
(1) constitutes, also, a slack-pulling line; and
(2) runs from said storage drum around said middle traction drive contained in said yarder, over said yarder tower, around said upper traction drive contained in said carriage, back over said yarder tower, around said left traction drive contained in said yarder, again over said yarder tower, through said carriage to said tailblocks, back to said carriage, again out of said carriage to said tailblocks, back through said carriage, over said yarder tower, around said right traction drive contained in said yarder, over said yarder tower, to said lower traction drive in said carriage, out of said carriage to a load;
(c) said source of power drives said traction drives, both in said yarder and in said carriage, in a fixed 1:1 ratio with respect to each other.

3. The system of claim 1 wherein:
(a) a secondary storage drum:
(1) upon which cable is wound after passing around said right traction drive in said yarder;
(2) upon which a slight counterclockwise rotational force is maintained such that when the system calls for cable this force can be be readily overcome enabling line to be withdrawn from said secondary storage drum, but when cable is released from the system said secondary storage drum readily accepts it;
(3) Which is distinct from any power drives enabling greater variation in the dimensions of said secondary storage drum and thus greater variation in the amount of line which can be stored on said secondary storage drum;
is contained;
(b) said carriage contains a skidding winch replacing the lower traction drive of the system of claim 2, upon which is wound a finite quantity of skidding line which runs from said skidding winch in said carriage, out of said carriage to a load;
(c) said single line runs from said storage drum (primary storage drum) around said middle traction drive contained in said yarder, over said yarder tower, around said upper traction drive contained in said carriage, back over said yarder tower, around said left traction drive contained in said yarder, again over said yarder tower, through said carriage to said tailblocks, back to said carriage, again out to said tailblocks, back through said carriage, over said yarder tower, around said right traction drive contained in said yarder, to said secondary storage drum;
(d) said source of power drives said traction drives, both in said yarder and in said carriage, and said skidding winch in said carriage in a fixed 1:1 ratio with respect to each other.

4. The system of claim 2 wherein said upper and lower traction drives contained in said carriage can be disengaged from each other, thus enabling the system to be tightened or loosened and said carriage to rise or fall in elevation respectively, through a mechanism which permits said lower traction drive to recede from said upper traction drive whenever there is a load on the dropline or whenever an enlargement on the end of the dropline is pulled tight against the bottom of said carriage.

5. The system of claim 3 wherein:
(a) said upper traction drive contained in said carriage and said skidding winch contained in said carriage can be disengaged from each other, thus enabling the system to be tightened or loosened and said carriage to rise or fall in elevation respectively, through a mechanism which permits said skidding winch to recede from said upper traction drive whenever there is a load on the dropline or whenever an enlargment on the end of the dropline is pulled tight against the bottom of said carriage; and
(b) said skidding winch is braked and prevented from unwinding, thereby being capable of suspending a load without dropping said load.

6. The system of claim 3 wherein said power source can be made to establish a drive ratio other than unity between said traction drive and said skidding winch such that the load upon the dropline may be significantly greater than that in the segment of the main cable which passes around said traction drives.

7. The system of claim 5 wherein said power source can be made to establish a drive ratio other than unity between said traction drives and said skidding winch such that the load upon the dropline may be significantly greater than that in the segment of the main cable which passes around said traction drives.

8. The system of claim 3 wherein it is possible through hydraulic drive mechanisms or mechanical brakes to arrange for either or both of said storage drums (primary and secondary) to slip whenever the load in any portion of the main cable exceeds a specified level.

9. The system of claim 5 wherein it is possible through hydraulic drive mechanisms or mechanical brakes to arrange for either or both of said storage drums (primary and secondary) to slip whenever the load in any portion of the main cable exceeds a specified level.

10. The system of claim 6 wherein it is possible through hydraulic drive mechanisms or mechanical brakes to arrange for either or both of said storage drums (primary or secondary) to slip whenever the load in any portion of the main cable exceeds a specified level.

11. The system of claim 7 wherein it is possible through hydraulic drive mechanisms or mechanical brakes to arrange for either or both of said storage drums (primary and secondary) to slip whenever the load in any portion of the main cable exceeds a specified level.

* * * * *